US005155987A

United States Patent [19]

Vogel

[11] Patent Number: 5,155,987

[45] Date of Patent: Oct. 20, 1992

[54] SPLICING ARRANGEMENT FOR THE CONNECTING OF YARNS

[75] Inventor: Armin Vogel, Gingen/Fils, Fed. Rep. of Germany

[73] Assignee: Wilhelm Stahlecker GmbH, Fed. Rep. of Germany

[21] Appl. No.: 669,002

[22] Filed: Mar. 13, 1991

[30] Foreign Application Priority Data

Mar. 17, 1990 [DE] Fed. Rep. of Germany ..... 4008640

[51] Int. Cl.[5] ..... D01H 15/00; B65H 69/06

[52] U.S. Cl. ..... 57/22; 57/261; 57/263

[58] Field of Search ..... 57/22, 261, 263

[56] References Cited

U.S. PATENT DOCUMENTS 4,494,367 1/1985 Badiali ..... 57/261 X
4,494,368 1/1985 Mima ..... 57/263 X
4,499,715 2/1985 Chardon et al. ..... 57/261 X
4,738,093 3/1988 Zumfeld et al. ..... 57/263 X

FOREIGN PATENT DOCUMENTS 3151270 7/1983 Fed. Rep. of Germany .
658445 11/1986 Switzerland .

*Primary Examiner*—Daniel Stadola
*Assistant Examiner*—William Stryjewski
*Attorney, Agent, or Firm*—Evenson, Wands, Edwards, Lenahan & McKeown

[57] ABSTRACT

A splicing arrangement for the connecting of yarns, particularly of staple fiber yarns. The splicing arrangement includes a splicing head, yarn clamps, cutting devices, loop pulling devices and devices for preparing the yarn ends which were cut with respect to their length. It is provided that the devices for preparing the yarn ends each comprise a friction surface in the form of a driven apron which moves in the direction of the yarn end, the apron, together with a countersurface, forming a gap receiving the yarn end to be prepared.

24 Claims, 1 Drawing Sheet

SPLICING ARRANGEMENT FOR THE CONNECTING OF YARNS

BACKGROUND AND SUMMARY OF THE INVENTION

The invention relates to a splicing arrangement for the connecting of yarns, particularly staple fiber yarns. Such splicing arrangement has a splicing head comprising a longitudinal groove for receiving the yarns to be spliced, yarn clamps, cutting devices, loop pulling devices and devices for preparing the yarn ends cut with respect to the length which are arranged on both sides of the longitudinal groove and each contain a friction surface moving toward the end of the yarn ends introduced into it.

In order to obtain a spliced connection which has high strength and differs as little as possible from the remaining yarn, it is, as a rule, necessary to prepare the yarn ends. In this case, the spinning twist is removed from the fiber ends, and the fiber ends are thinned out. In practice, it is generally customary to use devices for the preparing of yarn ends in which the preparing takes place by an effect of air currents, particularly compressed-air jets (see Swiss Patent Document CH-A 658445). Although devices of this type technically are relatively easy to implement, the difficulty exists of apportioning the preparation such that, on the one hand, the yarn ends are prepared sufficiently but, on the other hand, are not thinned out excessively and, under certain circumstances, are also not shortened too much. In this case, the intensity of the preparation is set by the duration of the influence of the air jets on the fiber ends.

Although it has become known to combine the preparation by means of compressed-air jets with an additional preparation by means of the effect of a friction surface (German Patent Document DE-A 31 51 270), as far as is known, devices of this type have not been used in practice. In this known construction, the yarn ends are applied by means of the compressed-air jets to a turbine rotor which is acted upon on the outside and is driven by means of the compressed-air jets. This turbine rotor, onto the circumference of which the yarn end is blown, has the purpose of causing a rubbing, pulling and tearing treatment of the fiber ends. By means of this relatively expensive device, it is, however, also not possible to cause a preparation of the yarn ends to precisely the desired extent of the opening-up.

It is an object of the invention to provide a splicing arrangement of the initially mentioned type with a device for preparing the yarn ends in which the preparing can be adjusted very precisely and is carried out in a controlled manner.

This object is achieved according to the invention by providing an arrangement wherein a driven apron is used in each case as the friction surface and, with a countersurface, forms a gap receiving the yarn end to be prepared. In this manner, a purely mechanical preparation of the yarn ends is carried out that can be precisely controlled. In this case, it is another advantage that this preparing is not dependent on the direction of the twist that was previously contained in the yarn. The purely mechanical effects can in this case be precisely controlled, not only with respect to their duration but also with respect to their intensity and length.

In an advantageous development of preferred embodiments of the invention, it is provided that the gap tapers in a wedge shape away from the inlet side. This results in the special advantage that the mechanical effect on the yarn ends increases in the direction of the actual end so that a particularly advantageous thinning-out of the yarn can be implemented in a controlled manner. In an advantageous development, it is also provided that the apron is guided on the inlet side, around a deflecting element, the distance of which can be adjusted with respect to the countersurface. As a result, the tapering of the wedge-shaped gap can be adjusted and can be adapted to the yarn to be spliced. In particular, an adaptation to the staple lengths of the fibers of the yarn to be spliced is also possible in this manner.

In a further development of the invention, it is provided that a second apron, which moves in the same direction as the first apron, is provided as the countersurface. In this manner, it is achieved that the yarn ends are worked from two sides, so that a very uniform preparation is achieved.

Other objects, advantages and novel features of the present invention will become apparent from the following detailed description of the invention when considered in conjunction with the accompanying drawings.

DETAILED DESCRIPTION OF THE DRAWINGS

Figure 1:
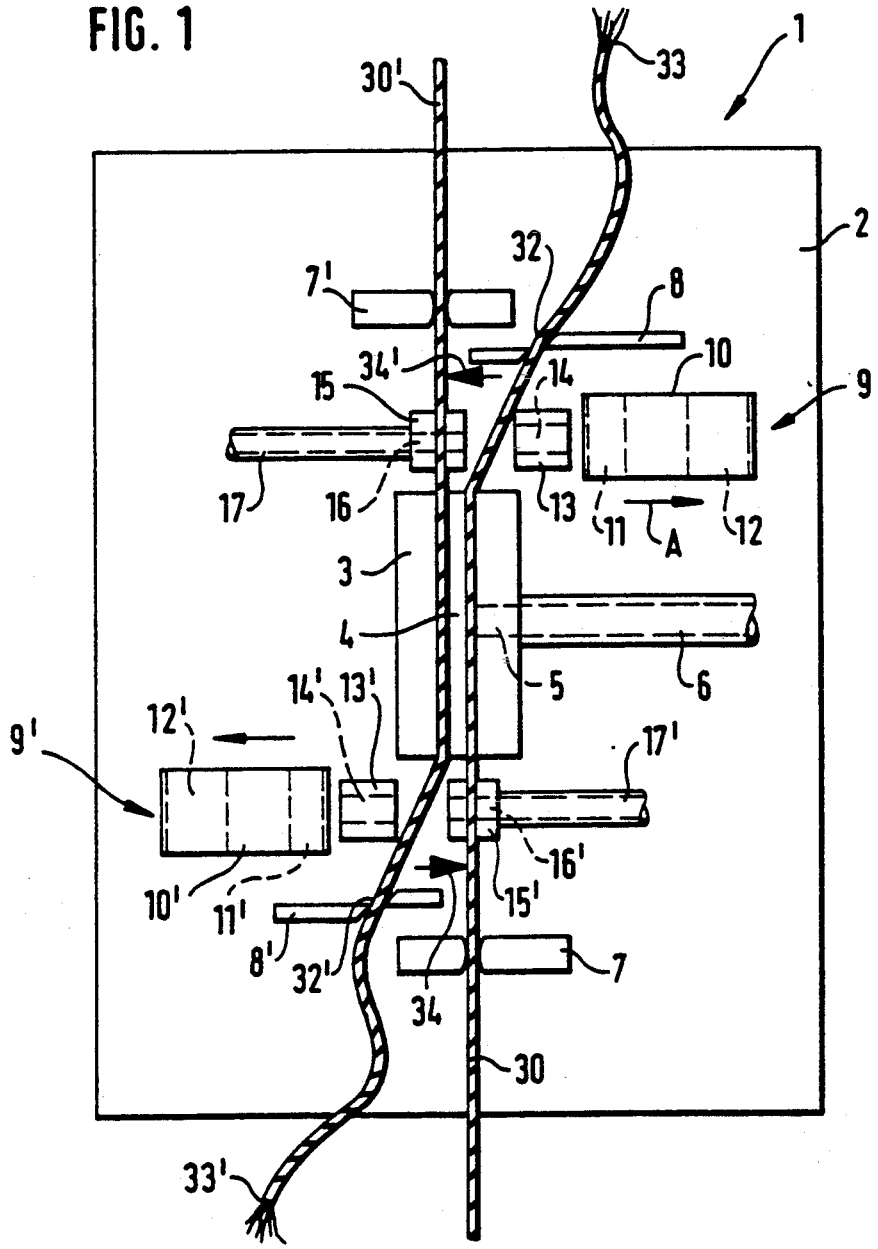
FIG. 1 is a top view of a schematically illustrated splicing arrangement constructed according to a preferred embodiment of the present invention.

The splicing arrangement shown in FIG. 1 has a base plate 2 on which the different elements are arranged which are largely shown only schematically. The splicing arrangement 1 comprises a splicing head 3 which has a longitudinal groove 5 serving as the splicing chamber, into which two yarns 30, 30' that are to be spliced, are inserted in opposite directions. At least one compressed-air nozzle 5, which by way of a line 6 is provided with air by a not shown compressed-air supply system, leads into the longitudinal groove 4 which, during the splicing, is covered by a covering which is not shown.

For the yarns 30, 30' which are placed in opposite directions in the splicing groove 4 of the splicing head 3, yarn clamps 7, 7' are provided in each case on the inlet side. Yarn clamps 7, 7' have clamping jaws that can be applied to one another and which hold the inserted yarns 30, 30', after the inserting, until the splicing connection is established. The free ends 33, 33' of both yarns 30, 30' are each inserted in cutting devices 8, 8' which are arranged with respect to the splicing head 3 on the sides opposite the clamps 7, 7'.

Before the actual splicing, the cutting devices 8, 8' are actuated so that new yarn ends 32, 32' are produced which have a defined length.

The new yarn ends 32, 32' are prepared before the actual splicing by which the spinning twist is removed from them and they are thinned out. This preparation takes place by means of devices 9, 9' which are each arranged on both sides of the longitudinal groove 4 on the side of the cutting devices 8, 8'. These devices 9, 9' will be described in detail.

After the preparation of the fiber ends 32, 32', which are first produced by cutting, these are pulled into the longitudinal groove 4 of the splicing head 3 by the actuating of so-called loop pulling devices 34, 34'. These loop pulling devices 34, 34' are each arranged between the yarn clamp 7, 7' and the splicing head 3 and are assigned to the yarn 30, 30' which is held by the respective yarn clamp 7, 7'. After the prepared yarn ends 32, 32' were pulled into the longitudinal groove 4, the actual splicing operation takes place by means of a very brief blowing-in of a compressed-air jet, which mixes and swirls together the fibers of these yarn ends. By preparing the yarn ends 32, 32', it is achieved that, on the one hand, the produced spliced point has a thickness which is smaller than twice the yarn thickness, while, on the other hand, free yarns ends are avoided that project from the spliced point.

The preparation of the yarn ends 32, 32' takes place in the above-mentioned devices 9, 9' which are each arranged in the direct proximity on both sides of the longitudinal groove 4 of the splicing head 3 and which, after the yarn ends 32, 32' were produced by means of the cutting devices 8, 8', receive the new yarns ends 32, 32'. The two devices 9, 9' have an identical construction so that only device 9 will be explained by means of the following description and FIG. 2. The devices 9, 9' are aligned essentially perpendicularly with respect to the longitudinal groove 4 of the splicing head 3. The devices 9, 9' each comprise an apron unit having two aprons 10, 18 which are arranged mirror-symmetrically with respect to a gap 21 which receives the yarn end 32 to be prepared. On the inlet side 22 of the gap 21, the apron 10 is guided around a deflecting rail 11 and wound around a driving roller 12 which is driven in the direction of the arrow (C) by means of a controllable driving motor which is not shown. On the inlet side 22 of the gap 21, the apron 18 is guided around a deflecting rail 20 and is wound around a deflecting roller 19. The deflecting roller 19 is arranged in such a manner that the aprons 10, 18 between the driving roller 12 and the deflecting roller 19 are pressed against one another so that the apron 18 and its deflecting roller 19 are driven. The deflecting roller 19 runs in the direction of arrow (B). Both aprons 10, 18 run away from the entry side 22 of the gap 21 in the direction of the arrow (A).

A guiding element 13, which forms a guide duct 14 directed to the inlet side 22, is connected to the inlet side 22 of the gap 21. A blow nozzle 15 is assigned to this guide duct 14. The blow opening 16 of the blow nozzle 15, which is connected to a compressed-air line 17, is directed to the guide duct 14. As illustrated in FIG. 1, the devices 9, 9' are each situated between the cutting devices 8, 8' and the splicing head 3. The guiding element 13, 13' and the blow nozzle 15, 15' are arranged in such a manner that the yarn area of the yarns 30, 30' travelling to the cutting device 8, 8' is disposed between the blow nozzle 15, 15' and the guiding element 13. By means of the actuating of the cutting devices 8, 8', an actuating of the blow nozzles 15, 15' takes place so that the released yarn ends 32, 32' are blown into the guiding element and into the inlet sides 22 of the gaps 21 of devices 9, 9'. The yarn ends 32, 32', which enter between the aprons 10, 18, are then prepared by means of the mechanical effect of the aprons 10, 18. In the process, their spinning twist is removed from them, in which case mainly short, not extensively bound-in fibers are pulled out of the yarn ends 32, 32'.

The aprons 10, 18 are those conventionally used in apron sets of drafting units. They have a largely smooth, not especially prepared surface made of a rubber-elastic material.

The yarn ends 32, 32' are preferably inserted into the gap 21 only to such an extent that the aprons 10, 18 do not exercise excessive clamping forces on the yarn ends 32, 32'. On the contrary, it is sufficient that a stroking motion is carried out in the longitudinal direction of the yarn ends 32, 32'.

Figure 2:
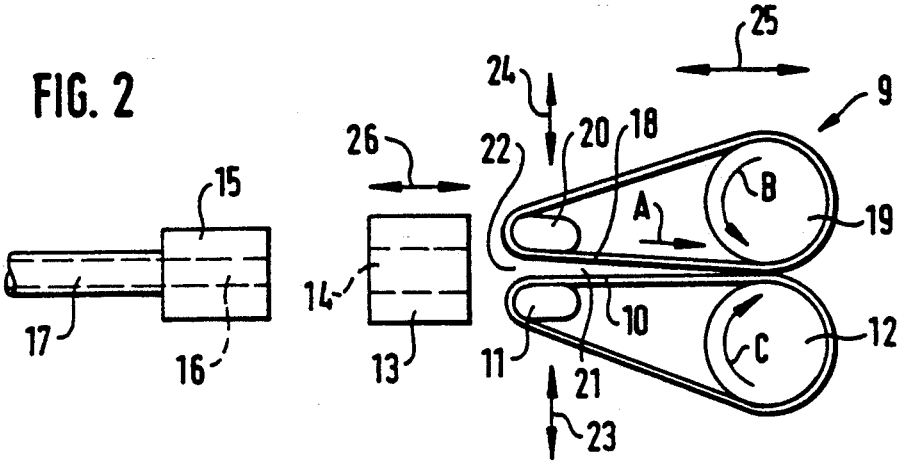
FIG. 2 is a slightly enlarged lateral view of a device for preparing a yarn end of the splicing arrangement according to FIG. 1.

As indicated in FIG. 2 by means of arrows 23, 24, at least one of the deflecting rails 11, 20 can be adjusted such that the distance between the aprons 10, 18 is enlarged or reduced in the area of the inlet side 22 of the gap 21. As a result, the intensity of the effect on the respective yarn end can be influenced, and particularly also the length with which the aprons 10, 18 affect the respective yarn end 32, 32'. In addition, the effect of the aprons 10, 18 can also be altered by a change of the rotational speed of the driving motor of the driving roller 12 according to preferred embodiments of the invention. In addition, it is possible to vary the length of the yarn ends 32, 32' on which the mechanical effect takes place in that the whole apron set is displaced in the running direction of the aprons 10, 18, as indicated in FIG. 2 by means of the arrow 25. For this purpose, it is possible to arrange the whole apron set in a carriage which is fastened on the base plate 2 so that it can be slid correspondingly. It is also possible to adjust the guiding element 13, 13' in such a manner that the length is changed with which the yarn ends 32, 32' project into the gap 21 between the two aprons 10, 18.

In a modified embodiment, it is provided that only one apron 10 or 18 is provided, this apron naturally being drivable. A table-type guiding surface is then assigned to this apron 10 or 18 as a countersurface which then forms a corresponding gap 21 with the apron 10 or 18.

The above-explained embodiment has had particularly good results for the preparation of yarns from fiber material which were produced by air spinning as only prestrengthened yarns, are wound onto a spool as a double yarn, and are subsequently twisted together for achieving the final strength. It was found that these yarn components, as individual yarn components or also as double yarn components, can be prepared by means of the above-explained devices 9, 9' in a very controlled manner so that subsequently very good spliced connections are obtained.

In a further modified embodiment, it is provided that the guiding elements 13, 13' are equipped with an additional yarn clamp which is actuated during the preparation of the yarn ends 32, 32' and clamps the yarn ends 32, 32'. In this case, it may be permitted that, during the preparation, as a result of the aprons 10, 18, a certain drafting takes place in the area of the yarn ends 32, 32' whereby their diameter is reduced in this area.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A splicing arrangement for splicing yarns comprising yarn end preparing means for preparing yarn ends to be spliced, said yarn end preparing means including:

a first flexible apron having a fist friction surface engageable with a yarn end section, a countersurface facing the first friction surface of the first apron to form a yarn end receiving gap between the first friction surface and the countersurface, and first apron driving means for driving the first apron with the first friction surface moving toward a free end of said yarn end section to apply a frictional force on the yarn in the longitudinal direction of the yarn ends.

2. A splicing arrangement according to claim 1, wherein the gap tapers in a wedge shape away from its inlet side.

3. A splicing arrangement according to claim 2, wherein the first apron is guided on the inlet side of the gap around a deflecting element and wherein deflecting element adjusting means are provided for adjusting the distance between the deflecting element and the countersurface.

4. A splicing arrangement according to claim 3, wherein one blow nozzle directed to the gap is arranged opposite inlet sides of the gap for controlling movement of the yarn end section into the gap.

5. A splicing arrangement according to claim 3, comprising:

a splicing head having a longitudinal groove for receiving the yarns to be spliced, and cutting means for cutting the yarns to be spliced, and yarn clamping means for holding the yarns while they are prepared and spliced, wherein one each of said cutting means and one each of said yarn end preparing means are provided at respective opposite longitudinal ends of the longitudinal groove for cutting and preparing yarn ends of respective yarns extending through said longitudinal groove while being clamped by the yarn clamp means.

6. A splicing arrangement according to claim 1, wherein the first apron is guided on the inlet side of the gap around a deflecting element and wherein deflecting element adjusting means are provided for adjusting the distance between the deflecting element and the countersurface.

7. A splicing arrangement according to claim 6, wherein a deflecting rail is used as the deflecting element of the inlet side.

8. A splicing arrangement according to claim 1, wherein a second apron is provided which has the countersurface, comprising second apron driving means for driving the second apron with the countersurface moving toward a free end of said yarn end section in the same direction as the first friction surface of the first apron.

9. A splicing arrangement according to claim 8, wherein the first apron is guided around a driving roller in a area facing away from the inlet side, and wherein the second apron is placed around a deflection roller which is arranged such that the first apron drives the second apron by means of friction.

10. A splicing arrangement according to claim 9, wherein the first apron is guided on the inlet side of the gap around a deflecting element and wherein deflecting element adjusting means are provided for adjusting the distance between the deflecting element and the countersurface.

11. A splicing arrangement according to claim 10, wherein a deflecting rail is sued as the deflecting element of the inlet side.

12. A splicing arrangement according to claim 9, wherein one blow nozzle directed to the gap is arranged opposite inlet sides of the gap for controlling movement of the yarn end section into the gap.

13. A splicing arrangement according to claim 9, comprising:

a splicing head having a longitudinal groove for receiving the yarns to be spliced, and cutting means for cutting the yarns to be spliced, and yarn clamping means for holding the yarns while they are prepared and spliced, wherein one each of said cutting means and one each of said yarn end preparing means are provided at respective opposite longitudinal ends of the longitudinal groove for cutting and preparing yarn ends of respective yarns extending through said longitudinal groove while being clamped by the yarn clamp means.

14. A splicing arrangement according to claim 13, comprising compressed air supply means for supplying compressed air to the splicing head longitudinal groove for effecting air splicing of the yarns.

15. A splicing arrangement according to claim 1, wherein one blow nozzle directed to the gap is arranged opposite inlet sides of the gap for controlling movement of the yarn end section into the gap.

16. A splicing arrangement according to claim 15, wherein one guide duct directed toward the gap is arranged between the blow nozzle and the inlet sides of the gap.

17. A splicing arrangement according to claim 16, comprising:

a splicing head having a longitudinal groove for receiving the yarns to be spliced, and cutting means for cutting the yarns to be spliced, and yarn clamping means for holding the yarns while they are prepared and spliced, wherein one each of said cutting means and one each of said yarn end preparing means are provided at respective opposite longitudinal ends of the longitudinal groove for cutting and preparing yarn ends of respective yarns extending through said longitudinal groove while being clamped by the yarn clamp means.

18. A splicing arrangement according to claim 17, wherein adjusting means are provided for adjusting the distance between the guide duct and a respective adjacent end of the longitudinal groove.

19. A splicing arrangement according to claim 15, comprising:

a splicing head having a longitudinal groove for receiving the yarns to be spliced, and cutting means for cutting the yarns to be spliced, and yarn clamping means for holding the yarns while they are prepared and spliced, wherein one each of said cutting means and one each of said yarn end preparing means are provided at respective opposite longitudinal ends of the longitudinal groove for cutting and preparing yarn ends of respective yarns extending through said longitudinal groove while being clamped by the yarn clamp means.

20. A splicing arrangement according to claim 19, comprising compressed air supply means for supplying compressed air to the splicing head longitudinal groove for effecting air splicing of the yarns.

21. A splicing arrangement according to claim 1, wherein apron speed adjusting means are provided for adjusting the speed of the first apron.

22. A splicing arrangement according to claim 1, comprising:

a splicing head having a longitudinal groove for receiving the yarns to be spliced, and cutting means for cutting the yarns to be spliced, and yarn clamping means for holding the yarns while they are prepared and spliced, wherein one each of said cutting means and one each of said yarn end preparing means are provided at respective opposite longitudinal ends of the longitudinal groove for cutting and preparing yarn ends of respective yarns extending through said longitudinal groove while being clamped by the yarn clamp means.

23. A splicing arrangement according to claim 22, wherein adjusting means are provided for adjusting the distance between the first apron and a respective adjacent end of the longitudinal groove.

24. A splicing arrangement according to claim 22, comprising compressed air supply means for supplying compressed air to the splicing head longitudinal groove for effecting air splicing of the yarns.

* * * * *